US006520852B2

(12) United States Patent
McKee et al.

(10) Patent No.: US 6,520,852 B2
(45) Date of Patent: Feb. 18, 2003

(54) VENT FOR VENTING A BUILDING ENCLOSURE

(75) Inventors: Jim McKee, Barrie (CA); James Mantyla, Barrie (CA)

(73) Assignee: Canplas Industries Ltd. (CA)

( * ) Notice: Subject to any disclaimer, the term of this patent is extended or adjusted under 35 U.S.C. 154(b) by 0 days.

(21) Appl. No.: 09/863,531

(22) Filed: May 23, 2001

(65) Prior Publication Data

US 2001/0049261 A1 Dec. 6, 2001

(30) Foreign Application Priority Data

May 29, 2000 (CA) ..... 2309941

(51) Int. Cl.[7] ..... F24F 7/02
(52) U.S. Cl. ..... 454/367; 52/199
(58) Field of Search ..... 454/366, 367, 454/368; 52/199

(56) References Cited

U.S. PATENT DOCUMENTS

| | | | | |
|---|---|---|---|---|
| 1,105,422 A | | 7/1914 | Griffiths | |
| 3,977,137 A | | 8/1976 | Patry | |
| 4,297,818 A | | 11/1981 | Anderson | 454/366 X |
| 4,451,024 A | * | 5/1984 | Shepherd | 144/195.7 |
| 4,472,915 A | | 9/1984 | Smith | |
| 4,526,407 A | | 7/1985 | Kifer | |
| 4,594,821 A | | 6/1986 | Bechtold et al. | |
| 4,702,049 A | | 10/1987 | Sampson et al. | |
| 4,803,816 A | * | 2/1989 | Klober | 454/368 |
| 5,005,328 A | * | 4/1991 | Holtgreve | 454/368 |
| 5,053,266 A | | 10/1991 | Hesketh et al. | |
| 5,251,411 A | | 10/1993 | Kelley et al. | |
| 5,414,964 A | | 5/1995 | Bodycomb | |
| 5,561,952 A | * | 10/1996 | Damron | 454/199 |
| 5,791,985 A | * | 8/1998 | Schiedegger et al. | 454/339 |
| 5,860,256 A | | 1/1999 | Humber | |
| 6,302,787 B1 | * | 10/2001 | Graft, Jr. | 454/358 |

FOREIGN PATENT DOCUMENTS

| | | | | |
|---|---|---|---|---|
| CA | 560069 | * | 7/1958 | 454/367 |

* cited by examiner

*Primary Examiner*—Harold Joyce
(74) *Attorney, Agent, or Firm*—Hoffmann & Baron, LLP

(57) ABSTRACT

A vent for venting a building enclosure having a perimeter flange having a nailing means being made of a material with a low coefficient of thermal expansion, such as for example sheet aluminum. The vent further includes a grill structure and a cap. The cap is made from dent resistant plastic to facilitate mass production and low return rates. In a preferred form of the invention the grill structure is also plastic and is molded onto the low coefficient of thermal expansion nailing means. A method of molding the grill structure onto the nailing means is also shown.

16 Claims, 4 Drawing Sheets

VENT FOR VENTING A BUILDING ENCLOSURE

FIELD OF THE INVENTION

This invention relates generally to the field of building products of the type used in residential and commercial construction and more particularly to ventilation products which are used to provide ventilation for interior air spaces such as attics and the like.

BACKGROUND OF THE INVENTION

Virtually all buildings and structural enclosures where human activity takes place require venting of one type or another. The type of venting device employed to provide such venting will depend on the kind of enclosure to be vented and the use to which the vented space is put. For example, bathrooms containing showers typically have active vents with fans to vent moist air and steam from the enclosed bathroom to the outdoors. Kitchens, particularly in restaurants and hotels, similarly have powered vents for removing cooking byproducts such as smoke and steam to the outdoors.

Other interior spaces, such as attics and yard sheds, do not require active venting. However, such enclosures do typically require a passive vent to permit air flow from the enclosure to the atmosphere. Such venting is required, for example, to prevent a buildup of moisture in the space within the enclosure. Passive vents do not include a mechanism for forcing air out of the enclosure. Rather, they simply include a vent structure in the form of an air passageway which allows air to flow through the vent structure.

Whether active or passive, the venting of an interior space of a building enclosure involves making a hole in the building envelope, such as in a roof, and then covering the hole to prevent rain, inclement weather and pests such as birds and animals from entering the enclosure through the hole while at the same time permitting the passage of air into and out of the interior space of the building. While there are many different types and designs of vents, both active and passive vents include generally the same elements, namely, a nailing flange or flashing strip to attach the vent around the hole in the building enclosure, a grill across the hole to keep out unwanted pests while allowing air to pass through and a cap to prevent rain, snow or the like from impinging upon the grill. In active vents there will also be provided a motor driven fan associated with the grill so as to forcibly drive vented air out of the interior space of the building enclosure.

Typically the nailing flange of the vent is made larger than the hole formed in the building envelope, so that the vent can be fixed in place around the hole. For a roof application, the flange is then underlapped and overlapped with for example roofing shingles, to provide for water shedding along the roof past the vent structure.

In the past, roof vents have tended to be made from metal such as galvanized steel or aluminum. Metal has certain advantages including, that it can be formed to exact shapes and according to precise specifications, and depending upon the metal, it is durable in the sense that aluminum, for example, is generally not degraded by exposure to the elements such as rain and sunlight. However, metal can also be difficult to work with, expensive to form and products made from thin metal can be fragile. In a vent, the metal is not required to carry any significant loads. To save material and cost therefore typically quite thin metal is used. Thin sheet metal is easily bent which may assist in forming the vent in the first place, but also means that the formed product can be damaged easily.

Quite simply the thin sheet metal will be easy to bend into and then possibly out of the desired shape. Any bumps or knocks which typically occur during shipping can leave dents in the surface of the vent cover which then make the vent unacceptable to customers. Alternately the base may become misshapen and twisted making it difficult to attach the device onto a planar surface of the building enclosure such as a roof. Sheet metal vents therefore tend to suffer from very high return rates due to delivery or other incidental damage. Also, installers may desire a water proof seal between the flanges and the roofing shingles and thus installers tend to use various sealant compounds to seal the edges of the flange to the surface on top which the vent is being fixed, in addition to nailing.

More lately, plastic roof vents have been developed which are typically made by injection moulding or the like from thermoplastic resins, such as polypropylene. In this manner many units can be made quickly and for less cost than incurred in bending and forming sheet metal. Plastic roof vents are much more durable during transportation, handling and delivery, since any bumps or blows inflicted will tend to be resiliently absorbed by the plastic without any lasting marking or damage. Unlike thin sheet metal the plastic simply does not permanently deform under the ranges of stresses typically incurred in shipping. Therefore, the return rate for plastic vents is advantageously very low.

Plastic roof vents also suffer from various disadvantages however. For example, plastic tends to become brittle as it gets colder. The more brittle the plastic is the more likely it will fail under a sharp impact such as a hammer blow which is likely to occur as the vent is being installed. Most often such vents are secured in place by means of nails or the like, through the nailing flange, meaning that the plastic must be engineered to withstand significant impact blows at low temperatures such as may be found outside during winter. To develop acceptable impact properties requires the use of expensive additives to the plastic resin, which reduces the cost effectiveness of using moulded plastic and can be more difficult to mould properly.

Also, installers may wish to seal the flange of the metal vents to the roof surface with sealants. Many such sealants are incompatible with the most commonly used plastics and sealing of a plastic roof vent by an unskilled installer can lead to failure by reason of the sealant solvents dissolving the plastic flange material that the sealant comes into contact with. Lastly, the coefficient of thermal expansion of the plastic flange is relatively large, meaning that in the case of an increase in temperature (for example during a mid-summer heat wave) the plastic will expand, causing the flange to buckle and raise up the overlying shingles. This promotes a greater possibility of leaks under the roofing shingles. This tendency also encourages the use of sealing compounds in the mistaken belief that this will help to keep the flange closely attached to the underlying roof.

SUMMARY OF THE INVENTION

What is desired is a building product or outdoor ventilation product that is durable for shipping and handling and which therefore will not be easily damaged by incidental contact during shipping handling or display. What is also desired is a product which may be inexpensively and quickly mass produced so that the cost of the device is acceptable to purchasers. What is further desired is a product which is dimensionally stable through the range of temperatures typically experienced in outdoor weather to avoid thermally induced buckling and consequential lifting of roofing shingles or the like. What is further desired is a vent that does not require expensive additives to make the plastic cold impact resistant and which is compatible with sealants and their solvents which are typical to the building and in particular to the roofing trades.

Of course the foregoing objects are to be provided in association with a structure which meets the basic requirements of a vent, namely the cap to prevent inclement weather from impinging on the air passage screen; the air passage screen to permit the air to exchange between the interior and the exterior of the building, but to exclude pests and a flange portion which is easily and readily secured around an opening in the building enclosure and which can be readily secured thereto by conventional building techniques, for example, by nailing.

Therefore according to the present invention there is provided a vent for venting a building enclosure, said vent comprising:

a perimeter flange having a nailing means, said nailing means having a coefficient of thermal expansion less than about $3.5\times10^{-5}$ in./in ° F., said perimeter flange defining an opening to permit the passage of air therethrough;

a grill structure extending from said perimeter flange and being positioned relative to said opening to permit said air to pass through said grill structure, said grill structure being sized and shaped to prevent unwanted material from passing therethrough into said building enclosure; and a plastic moulded dent resistant cap sized, shaped and positioned in place above said grill structure to impede precipitation from impinging on said grill structure.

According to a second aspect of the present invention there is also provided a method of making components for a vent for venting a building enclosure comprising the steps of:

making a nailing flange;

inserting said nailing flange into a mold; and molding an grill structure onto said nailing flange to attach said grill structure to said nailing flange.

BRIEF DESCRIPTION OF THE DRAWINGS

Reference will now be made to the drawings which depict various preferred embodiments of the invention by way of example only and in which.

DETAILED DESCRIPTION OF THE PREFERRED EMBODIMENTS

Figure 1:
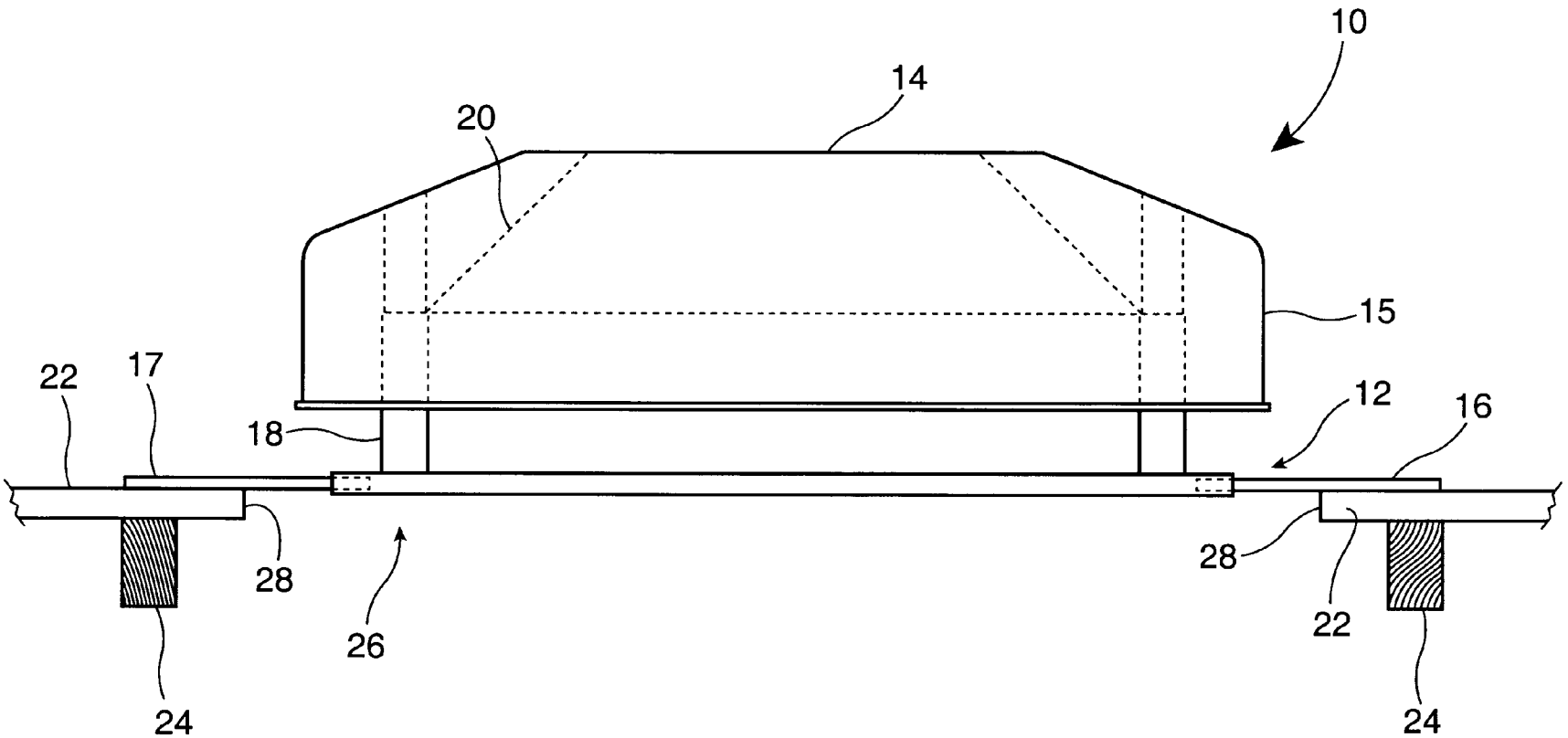
FIG. 1 is a side view of a roof vent according to the present invention in place over an opening.

FIG. 1 shows a vent structure according to one embodiment of the present invention indicated generally at 10. The vent structure is made from two main components, namely a base 12 and a cover or cap 14. The base 12 includes a perimeter flange 16 and an upstanding base portion 18. The upstanding base portion 18 further includes a grill structure 20 shown in dotted outline. It will be appreciated by those skilled in the art that there are many different configurations of base and grill structure that may be used. It has been found that good results are achieved with the raised grill structure as shown in the drawings, because this places the weather permeable grill 20 closely under the protective cap 14. This prevents nesting of birds and animals. Further if the cap 14 is provided with down turned side edges, the grill structure 20 can be completely covered, thereby proving a more weather proof structure, thus the base structure 12 as shown in the drawings is preferred.

Also shown is a roofing material 22 made from generally flat sheets such as plywood, which roofing material forms part of a building enclosure. The actual roof will typically have a slope or pitch, which will promote the shedding of water, snow and the like off the roof. The plywood is supported, for example, by beams 24, which may be conventional wooden members such as two by fours, two by sixes, or the like as required according to conventional building codes and engineering standards. As shown in FIG. 1 the roofing material 22 is not continuous, rather it includes an opening 26 defined by the edges 28. This opening 26 allows for air passage from inside of the building enclosure to the outside and vice versa. Typically the opening will be formed in the material 22 by the roofer or framer, when it comes time to install a vent.

The perimeter flange 16 of the vent 10 is for the purpose of attaching the vent 10 to the roof material 22. Typically this attachment is done by way of nails or screws. Typically nails are preferred because of the ease of installation, especially when using a nail driving gun or the like which is commonly used in roofing construction. According to the present invention, the perimeter flange 16 includes a nailing means 17, which most preferably comprises a metal having a coefficient of thermal expansion of below about $3.5\times10^{-6}$ in./in ° F. By way of reference, a typical used moldable plastic such as polypropylene has a coefficient of thermal expansion in the range of 5 to $7\times10^{-5}$ in./in ° F. Although lower coefficients are possibly for various specialty plastics, such plastics can lose important cold impact resistant properties and are more difficult to mold. A suitable low coefficient of thermal expansion material is for example sheet metal, most preferably aluminum. Various aluminum alloys have coefficients of thermal expansion of about 1.29, 1.27 and $1.11\times10^{-5}$ in./in ° F. Sheet aluminum has several desirable properties, in addition to a low coefficient of thermal expansion, such as the ability to take nails under almost any temperature conditions and a resistance to corrosion or the like that affects other metals. Aluminum, as other metals, is also completely inert to solvents of the type found in pitch, tar and other roof sealing compounds.

Extending up from the flange is an upstanding base portion 18 which in turn supports a grill portion 20. It can now be appreciated that the upstanding base portion 18 permits the grill structure 20 to be raised above the opening 28. In turn, the cap 22 is supported in a raised position above the grill structure 20. The cap 22 is supported above the grill 20 in a way to permit the passage of air through the grill 20 and out from under the cap 14.

The preferred form of the cap 22 is a one piece moulded plastic cap which can be made quickly and easily through injection moulding techniques. The cap portion 22 will be placed over the grill and fixed above the same to prevent inclement weather such as rain snow or the like from impinging on the grill 20. Most preferably the cap portion 14 will be made from moulded plastic or the like to permit the most visible part of the roof vent to absorb various bumps and the like without being damaged during shipping.

Figure 5:
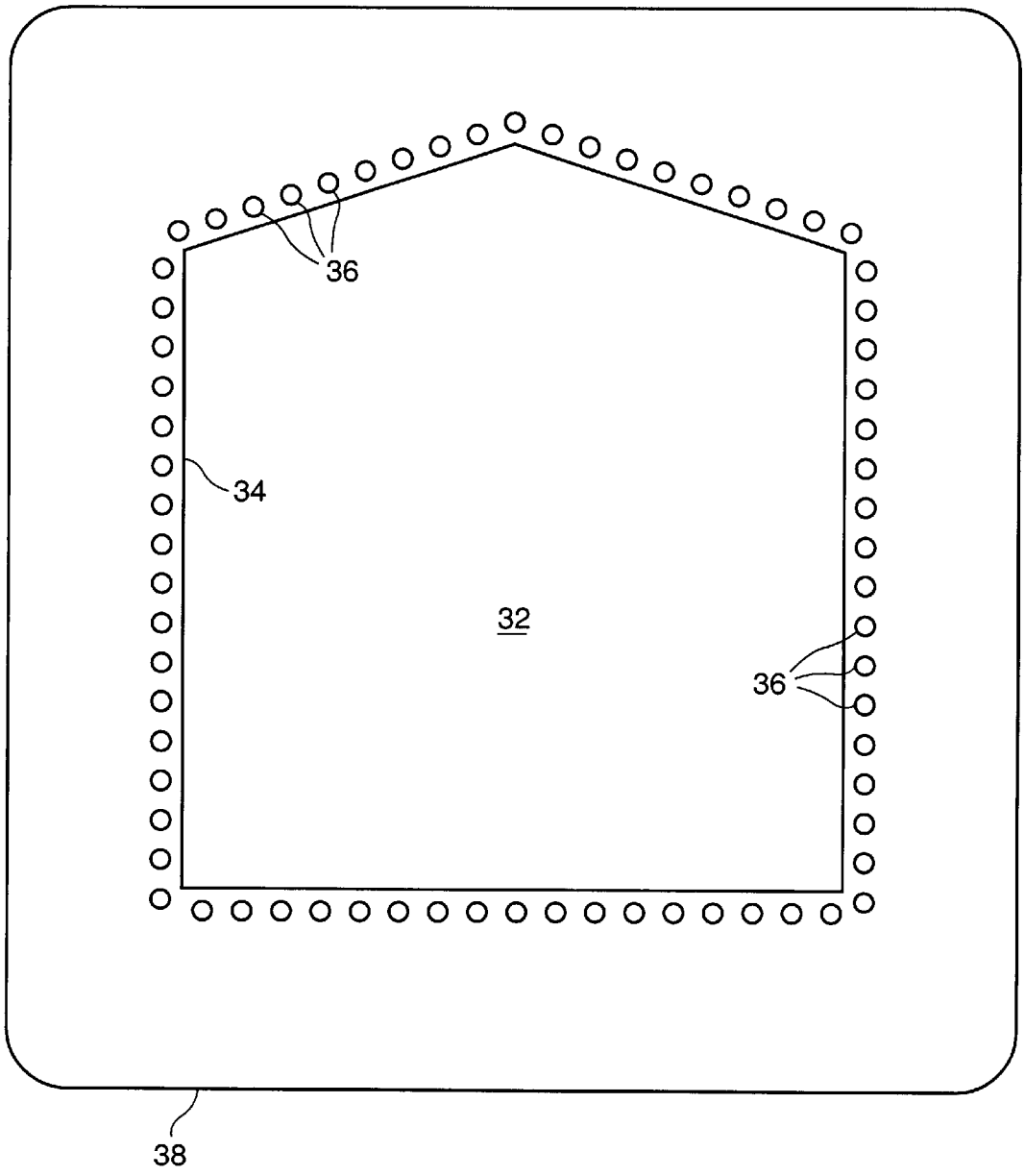
FIG. 5 is a top view of a nailing flange portion of the roof vent of FIGS. 1 and 3.

Turning back to the base 18, most preferably the base 18 is a composite base, formed from two different materials. Most preferably the nailing flange 17 is made from metal, while the upstanding portion 18 is made from molded plastic. The preferred method of constructing the base of the present invention is to mould the plastic direct onto the metal flange. As can be seen in FIG. 5 the preferred form of the nailing flange 17 is as a flat rectangular section 30 with a generally rectangular or square hole 32 formed in the middle. Most preferably the flange is continuous, so as to not provide any place where water can penetrate through the flange. Located around the inner periphery 34 are a plurality of anchor openings 36. The exact size and number of such openings can vary, but sufficient are required to permit a good bond to be formed between the upstanding portion 18 and the nailing flange 17.

In another embodiment of the present invention the flange could be formed from a combination of plastic and metal, such as for example metal sections which are connected together by lands of moulded plastic. This would still provide the opportunity to drive fasteners through the metal portion and to provide a flange which is less subject to size change during a change of temperature. However, because of the desire to distance the plastic from any sealant that might be applied, it is preferred to form the metal flange as a continuous flange which extends fully around the opening in the building enclosure.

The present invention therefore comprehends a connection between the preferred metal nailing flange and the plastic of the balance of the upstanding portion 18. This connection can be made a number of ways, but the most preferred way is to mould the plastic part onto the metal part so as to form a liquid tight seal. Reasonable results have been achieved by forming a plurality of anchor openings 36 in the metal flange along the edge 34 to be joined to the plastic base 18. Then when the plastic base 18 is moulded, the plastic will flow into and around the openings 36 providing a good mechanical bond which is also liquid tight. In this way, leaks and the like are prevented from occurring at the metal/plastic interface. Most preferably this interface occurs adjacent to the grill portion or the raised portion of the base as shown. Although various shapes and sizes of anchoring openings 36 can be used, circular openings of ⅛" diameter set on ⅜" centers has yielded reasonable results.

Figure 2:
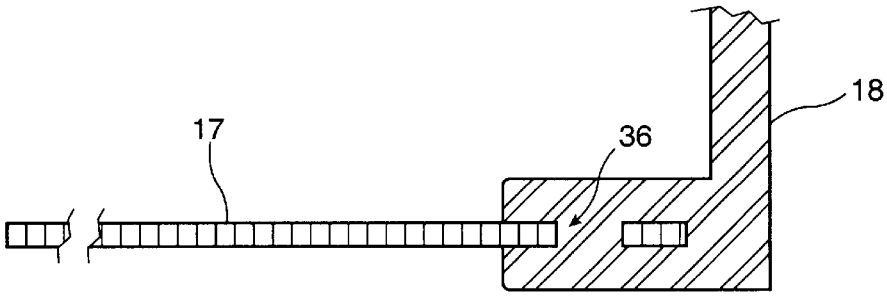
FIG. 2 is a cross-sectional view of a portion of the roof vent of FIG. 1.

Referring to FIG. 2, the metal nailing means 17 is shown with a part of the plastic upstanding portion 18 in section. This figure shows how the plastic has flowed into and around the opening 36 to form a good mechanical bond at an attachment portion 19. The plastic overlaps the nailing portion (both above and below in the nature of a sandwich), by an amount which is preferred to be between ¼" to 1". Greater amounts of overlaps will also work, but will require more plastic, which is expensive. Lesser amounts of overlap may also work, but will be weaker and less robust.

The most preferred way of making the present invention is to place the metal nailing means directly inside the plastic injection mould. The flange is guided and held in place as the mould parts come together and then the plastic is injected into the mould, which is clamped around the metal flange. The molten plastic flows into and around the holes 36 and then sets, to join the metal to the plastic. At the same time, the balance of the upstanding base, including the grill is also preferably formed, so that a composite material one piece part is produced from the mould. Thus, as the mould parts separate the finished base can be removed for further manufacture.

Figure 3:
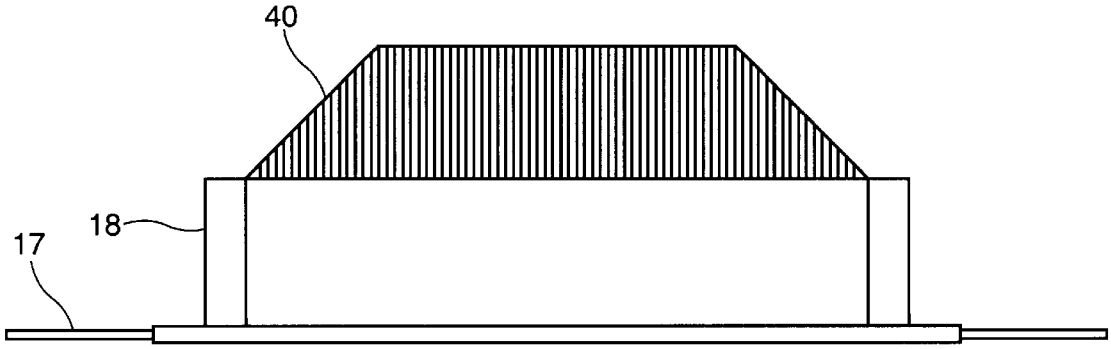
FIG. 3 is a view of a base portion of the roof vent of FIG. 1, without a cap.
Figure 4:
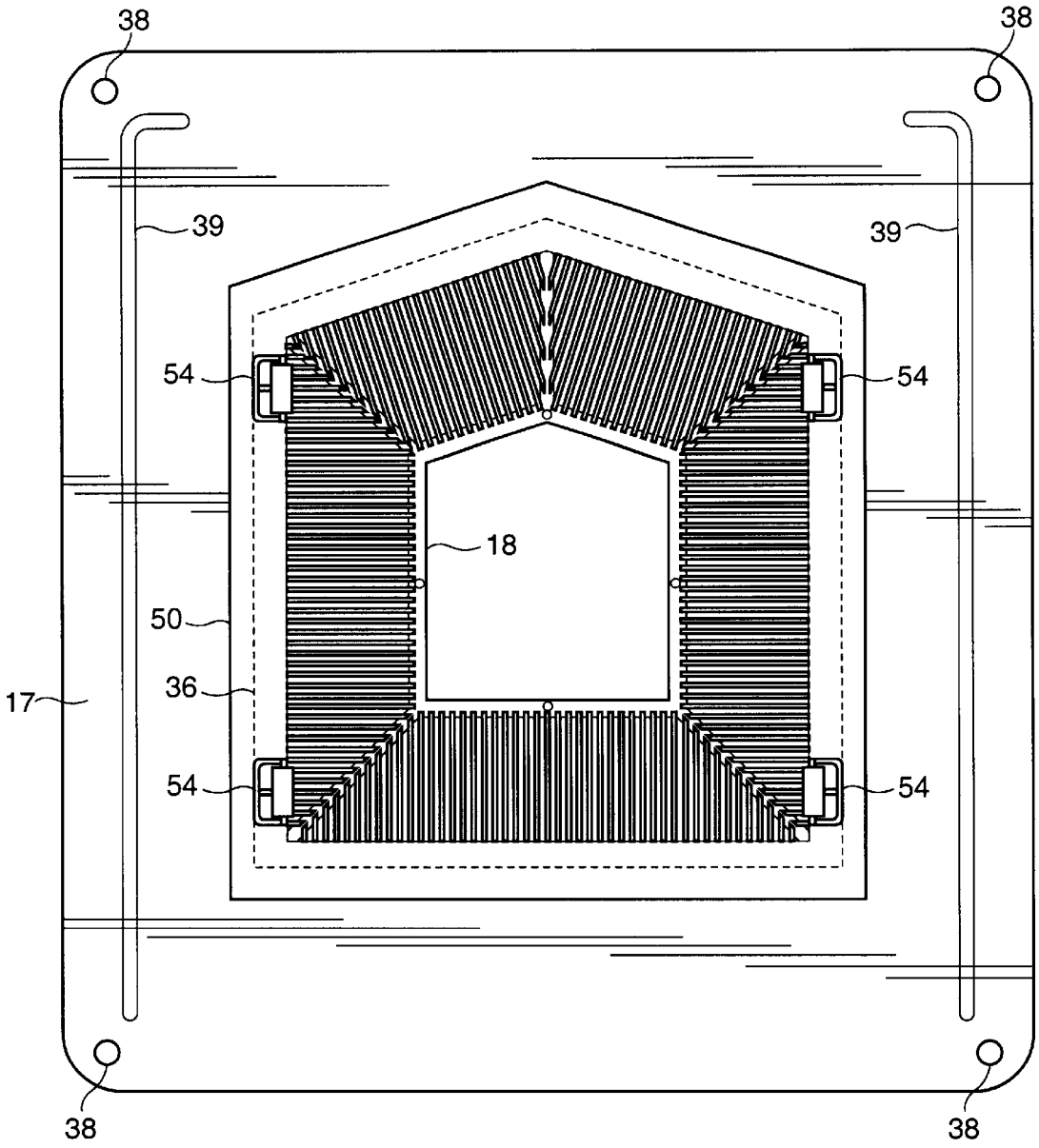
FIG. 4 is a top view of the roof vent of FIG. 1.

Referring now to FIG. 3, a finished part from the mold according to the most preferred aspect of the present invention is disclosed. As can be seen, the nailing flange 17 is integrally attached to the plastic base 18, which in turn has a molded grill 40. FIG. 4 shows the part of FIG. 3 from above the metal flange 17 and the plastic upstanding base portion 18. The top of the base 18 is shown as open, and would be closed by the cap 14 when it is installed onto the base. This portion could also be made with a grill if desired.

FIG. 4 shows the internal edge 34 in dotted outline and the plastic extending in an overlap to an edge 50. Also shown are channels 54 which are used to secure the cap 14 to the base 18. It is necessary to guide and position the nailing flange in the mold for accurate molding of the plastic onto the nailing flange. The mold may be made with a pocket and the nailing flange can be positioned for example by suction to keep it within the pocket. Alternately guides could be used to position the outer edges of the nailing flange relative to the mold.

Also shown is a raised drip guard 39 which prevents drips from migrating underneath the shingles. Alternately, the lateral edges of the nailing flange could be bent over to form an edge channel to cause any water migrating sideways to be funnelled down the side edge and out onto the top of shingles lower down.

It will be appreciated that other forms of the metal nailing section 17 can also be prepared. For example the metal section 17 could be bent into an upstanding wall to reduce the exposure of the metal plastic interface to water. However, forming an upturned edge is believed less preferred because the moulding takes place in high speed moulding machines in which the mould parts are rapidly brought together with much force for plastic injection and then as quickly separated for part ejection. With the preferred configuration, the mould closes onto a flat thin strip of metal. With an upstanding wall it is more likely that the mould would have to close towards the upstanding edge. If the upstanding wall onto which the plastic was to be moulded was slightly off line, it could damage the mould as the mould closes. Additionally, the configuration of the mould to accommodate the bent metal piece would likely be more complicated and thus more expensive. Therefore the most preferred form of the invention is one where the mould parts close onto a thin strip of metal onto which the plastic is being moulded.

It can now be understood the vent structure 10 may be placed on a building. In the first step, the perimeter flange 16 is secured in place to permit the vent structure 10 to cover the opening in the building enclosure. The flange 16 is installed at the same time as the roofing material is covered with weather protection, such as shingles. Shingles are laid by starting at a low point on any surface to be protected. Then, course after course are laid with the bottom of each next higher course covering the top of the course below. In this way, rain water and the like is always kept away from the underlying roofing material because for any water to get onto the same would require that the water run uphill to get over the top of the shingle course.

When encountering a ventilation opening such as 26, the typical procedure is to lay the course of shingles up to the bottom of the opening, and then to interleave the perimeter flange of the vent structure in with the shingle courses. In this way the bottom edge of the perimeter flange will be overlie the top edge of the shingle courses below it to cause water to be shed off the roof.

The perimeter flange 16 is sized and shaped to include a central opening which can be placed in registry with the opening 28 formed in the roofing material. Or course it is not required that the openings be exactly the same size, but it is necessary to permit the flow of air from one to the other in the usual manner.

The present invention also comprehends forming the flange and the grill from metal, and simply using a plastic cap to cover the metal base. However, this is also believed to be a less desirable form of the invention since the effort involved in making the more intricate portions, such as the screen is greater for metal than for plastic. Further, in the event the base is made from metal there is a greater risk that the device will be damaged during shipping or handling, since the base if knocked would retain the bend, and result in the plastic cap being off-centre. This would likely lead to higher reject rates The advantages of the present invention can now be understood. The most preferred form of the invention is a flat metal flange having a coefficient of thermal expansion of less than 5×10.5 in/in and most preferably less than about 3.5×10.5 in/in. The preferred form of the base and the cap is a thermal plastic resin which will elastically deform under moderate impacts. In this sense moderate impacts means the type of incidental banging and bumping that typically happens during shipping or the like. It can now be appreciated that the preferred nailing means overcomes the problem of the prior art, namely, it is compatible with sealants, is easily nailed in all weather conditions, is dimensionally stable under a wide range of temperatures, and will not decay or corrode. The preferred upstanding base and cap also include the benefits of being dent resistant and durable. Thus, the combined material vent of the present invention includes the benefits of both materials, without the liabilities of either. More specifically, even if the nailing means were to become bent during shipping, it could be easily straightened by being nailed to the roof. Any exposed edges can be sealed with sealant and in any event, the majority of the flange is covered with shingles. The remainder of the vent, the most visible portion, is made from dent resistant plastic which will not be harmed during shipping.

It will be appreciated by those skilled in the art that while reference has been made to preferred embodiments, various modifications can be made without departing from the spirit of the invention as defined by the broad claims below. Some of these have been discussed above and others will be apparent. What is important is for the invention to have the dent resistant cap or upstanding portion with a dimensionally stable and robust nailing means.

We claim:

1. A vent for venting a building enclosure, said vent comprising:

a perimeter flange having a nailing means, said nailing means having a coefficient of thermal expansion less than about $3.5\times10^{-5}$ in./in ° F., said perimeter flange defining an opening to permit the passage of air therethrough;

a plastic molded base portion disposed about said perimeter flange;

a grill structure extending from said perimeter flange and being positioned relative to said opening to permit air to pass through said grill structure, said grill structure being sized and shaped to prevent unwanted material from passing back into said building enclosure; and a dent resistant plastic molded cap sized, shaped and positioned in place above said grill structure to impede precipitation from impinging on said grill structure.

2. A vent for venting a building enclosure as claimed in claim 1 wherein said nailing means is a thin material which is capable of taking nails under a range of temperatures.

3. A vent for venting a building enclosure as claimed in claim 2 wherein said nailing means is sheet aluminum.

4. A vent for venting a building enclosure as claimed in claim 1 wherein said nailing means is a continuous flange made from sheet aluminum which defines a central opening.

5. A vent for venting a building enclosure as claimed in claim 4 wherein said nailing means includes a means for attaching plastic thereto.

6. A vent for venting a building enclosure as claimed in claim 5 wherein said means for attaching plastic thereto comprises a plurality of anchoring openings formed in said nailing means.

7. A vent for venting a building enclosure as claimed in claim 6 wherein said plurality of anchoring openings are sized shaped and positioned so as to permit plastic to be forced into said openings during molding.

8. A vent for venting a building enclosure as claimed in claim 5 wherein said grill structure is attached to said nailing portion in a liquid tight manner.

9. A vent for venting a building enclosure as claimed in claim 7 herein said grill portion includes a molded flange attachment portion which contacts both sides of said nailing flange.

10. A vent for venting a building enclosure as claimed in claim 9 wherein said flange attachment portion of said grill structure overlaps said nailing portion by between one quarter of an inch to one inch.

11. A method of making components for a vent for venting a building enclosure comprising the steps of:

making a nailing flange;

inserting said nailing flange into a mold; and molding an grill structure onto said nailing flange to attach said grill structure to said nailing flange.

12. The method of molding as claimed in claim 11 wherein said step of making a nailing flange comprises making a central opening in said nailing flange.

13. The method of molding as claimed in claim 12 wherein said step of making said nailing flange further comprises forming anchoring openings adjacent to said central opening in said nailing flange.

14. The method of molding as claimed in claim 11 wherein said step of inserting said nailing flange into a mold comprises guiding and holding the nailing flange in proper alignment during the molding process.

15. The method of molding as claimed in claim 11 wherein said step of molding said grill structure further comprises injection molding said grill structure.

16. A method of making a vent for venting a building enclosure comprising the steps of:

making a nailing flange;

inserting said nailing flange into a mold;

molding an grill structure onto said nailing flange to attach said grill structure to said nailing flange;

molding a dent resistant cap; and securing said cap to said grill structure.

* * * * *

UNITED STATES PATENT AND TRADEMARK OFFICE

CERTIFICATE OF CORRECTION

PATENT NO. : 6,520,852 B2 
DATED : February 18, 2003
INVENTOR(S) : Jim McKee and James Mantyla It is certified that error appears in the above-identified patent and that said Letters Patent is hereby corrected as shown below:

Column 3,
Line 43, "...molding an grill structure…" should read -- …molding a grill structure… --.

Column 4,
Line 40, "...are possibly for various…" should read -- ...are possible for various… --.

Column 5,
Line 45, "...centers has yielded…" should read -- ...centers have yielded… --.

Column 6,
Lines 63-64, "...flange will be overlie the top…" should read -- ...flange will overlie the top… --.

Column 7,
Line 1, "...material. Or course…" should read -- ...material. Of course… --.

Column 8,
Line 26, "Claim 7 herein said grill…" should read -- Claim 7 wherein said grill… --.
Lines 38 and 58, "...molding an grill structure…" should read -- ...molding a grill structure… --.

Signed and Sealed this

Second Day of September, 2003

JAMES E. ROGAN
*Director of the United States Patent and Trademark Office*